US006298915B1

(12) United States Patent
George

(10) Patent No.: US 6,298,915 B1
(45) Date of Patent: Oct. 9, 2001

(54) ORIENTING SYSTEM FOR MODULAR GUNS

(75) Inventor: Flint George, Flower Mound, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/395,682

(22) Filed: Sep. 13, 1999

(51) Int. Cl.[7] ..... E21B 49/119

(52) U.S. Cl. ..... 166/255.2; 166/55.1; 166/297; 175/4.51

(58) Field of Search ..... 166/255.2, 297, 166/55.1; 175/4.51, 452

(56) References Cited

U.S. PATENT DOCUMENTS

| | | | | |
|---|---|---|---|---|
| 3,291,208 | * | 12/1966 | Kenneday | 175/4.51 |
| 4,436,154 | | 3/1984 | Vann et al. | 166/281 |
| 5,366,014 | | 11/1994 | George | 166/297 |
| 6,003,599 | * | 12/1999 | Huber et al. | 175/4.51 |

FOREIGN PATENT DOCUMENTS

| | | | |
|---|---|---|---|
| 1 196 570 | 11/1985 | (CA) | 166/10 |
| 2 093 500 B | 8/1984 | (GB) . | |

OTHER PUBLICATIONS

Jan Hilding Ericksen, Saga Petroleum ASA, Francesco Sanfilippo, ORMIS, Arne L. Kvamsdal, Flint George, and Erling Kleppa, SPE, Halliburton Energy Services, Inc.; Orienting Live Well Perforating Technique Provides Innovative Sand Control Method in the North Sea; Oct. 3–6, 1999; pp. 1–16.

* cited by examiner

*Primary Examiner*—William Neuder
(74) *Attorney, Agent, or Firm*—Paul H. Herman; David W. Carstens

(57) ABSTRACT

A stinger is fabricated with an orientating key. The stinger is lowered into a wellbore and remains atop a downhole assembly. The angular orientation of stinger with respect to the downhole assemble is also adjustable prior to entering the wellbore. The stinger acts as a guide for coupling an alignment skirt. The alignment skirt is fabricated with an alignment slot for receiving the orientation key. The alignment skirt is lowered onto the stinger and, as inclines on the skirt engage the orientation key, the alignment skirt is rotated until the alignment slot receives the orientation key. The alignment skirt and stinger are then fully coupled. The angular orientation of the orientation key can be determined by coupling an alignment skirt to the stinger, where a directional tool is affixed to the alignment skirt and performs a directional survey. In subsequent runs in the wellbore, the angular orientation of a perforating assembly can be adjusted in order to align the direction of perforating charges with the gun assembly, with a preferred vertical plane on the formation. This is accomplished by orienting (rotating) the alignment skirt and stinger on the gun assembly with respect to the orientation of the perforating charges and the orientation of the preferred vertical plane of the formation.

29 Claims, 8 Drawing Sheets

ORIENTING SYSTEM FOR MODULAR GUNS

BACKGROUND OF THE INVENTION

1. Technical Field

The present invention relates to a method and apparatus for properly orienting a modular downhole tool such as a perforation gun. Specifically, it relates to an apparatus that allows the tool to be positioned with a particular angular orientation.

2. Description of the Related Art

Perforating casing in a wellbore involves lowering a perforating gun or guns into the wellbore, positioning the gun(s) adjacent to the geological zone intended to be perforated, and detonating the perforating gun(s). The geological zone of interest is generally laid down in a horizontal plane. However, geological formation attributes such as porosity and/or permeability may vary around the circumference of the wellbore. A preferred vertical plane may exist within the horizontal plane of the formation for porosity and/or permeability. In such a preferred vertical plane, the porosity and/or permeability of the formation may be more advantageous for producing hydrocarbons from the formation. Therefore, orienting the perforating gun(s) with respect to the preferred vertical plane of the formation would tend to increase the producibility of the well. Other advantages gained from orienting the perforating gun(s) with respect to the direction of the preferred vertical plane might be realized in mechanical fracturing operations, as well as in acidizing operations performed on the formation of interest. By orienting the perforations with the preferred vertical plane, the hydraulic pressure for fracturing and the reactive acid from acidizing are aligned with the best possible porosity and/or permeability vertical plane, which allows each to penetrate deeper into the formation. Also, in a situation where a well is blowing out and a relief well is drilled for diverting the blowout pressure and flow, complete control over the relief well is maintained by perforating into the blowout well from the relief, rather than drilling into the blowout. Oriented perforating provides a means for maximizing the communication between wells.

A problem with current technology is the inability to orient slickline perforating guns along the maximum horizontal stress while simultaneously perforating an entire zone in a given vertical direction in order to lessen the effects of sanding in a newly perforated well.

The perforating gun(s) can be conveyed into the well using either tubing or wireline as a conveyance. By using tubing as the conveyance, the perforating charges within the perforating gun may be oriented at a 180° phase from each other, which enables the well operator to perforate only in the angular orientation of the preferred vertical plane without wasting perforating charges oriented at other directions. This is performed by lowering the perforating gun(s) into the wellbore attached to the tubing, and once the perforating gun is positioned across the formation of interest, a direction survey is performed for finding the orientation of the perforation gun(s) with respect to the preferred vertical plane. Running the perforating gun(s) on tubing requires a special anchoring device on bottom of the stringer or, without anchoring device, firing is limited to a mechanically operated firing head. With an anchoring device the perforation gun(s) can be fired with pressure.

A wireline or slickline unit is normally used for running the direction survey. By using a wireline the operator gets a real time readout of the orientation of the perforating gun at the surface. Once the orientation of the perforating gun(s) is determined, the tubing is rotated a corresponding amount for angular orientation of the perforating gun(s) with respect to the preferred vertical plane. Normally, the wellbore is then perforated after rotating the tubing; however, in the case of highly deviated and/or exceptionally deep wells, a second directional survey might be performed in order to confirm that the rotation applied to the tubing at the surface has been completely transferred to the downhole perforating gun(s). While use of tubing as the conveyance for the perforating gun(s), in combination with performing a direction survey, guarantees orientation accuracy, the procedure is relatively expensive, as it requires the use of both a workover rig for conveying the tubing, and, a wireline or slickline unit for running the direction survey.

Alternatively, the perforating gun(s) can be conveyed into the well using wireline as a conveyance, thus eliminating the need for a workover rig. One method of perforating using wireline is by employing the modular perforating method and apparatus disclosed in U.S. Pat. No. 5,366,014, titled "Method And Apparatus For Perforating A Well Using A Modular Perforating Gun System," by George, incorporated in its entirety here within by reference. FIGS. 1A and 1B depict perforating a wellbore using a modular gun assembly. Initially, gun hanger 110 is inserted into casing 100 and positioned below formation 120 using collar locator 140, which is attached through a cable head to a cable, either wireline or slickline. Gun hanger 110 is then set using a running tool 150 (shown in a cutaway view in order to view stinger 130B). Running tool 150 and collar locator 140 are then retrieved from the wellbore, leaving stinger 130A in an upturned position on top of gun hanger 110.

With gun hanger 110 in position, modular perforating gun 160, which includes upper gun head 180 and alignment skirt 170, is run inside casing 100 using collar locator 140 and running tool 150, similar to running gun hanger 110 into the wellbore. Alignment skirt 170 is coupled to upturned stinger 130A, which causes perforating charges 162 to be positioned at depths adjacent to formation 120 (FIG. 1A depicts perforating gun 160 just prior to coupling of skirt 170 and stinger 130A). Also included are centralizers 190 for centering alignment skirt 170 in casing 100, for ensuring that alignment skirt will mate properly with stinger 130A.

FIG. 1B depicts a top view of casing 100, which also shows the orientation of perforating gun 160 relative to preferred vertical plane 195. Note that perforating gun 160 is loaded with perforating charges 162, positioned at four shots per foot and oriented at a 90° phase from each other. In the above described shot configuration, no perforating charge is oriented in parallel with preferred vertical plane 195. Instead, each of perforating charges 162 is oriented 45° away from the preferred vertical plane. Therefore, it would be expected that the wellbore would produce hydrocarbons at a lower rate than if perforating charges 162 were oriented in parallel with preferred vertical plane 195 . Note that, in the depicted example, only half of the perforating charges can ever be aligned with (or in phase with) preferred vertical plane 195. The remaining charges will be oriented 90° away from preferred vertical plane 195. Therefore, it is expected that the perforations created from those perforating charges will produce hydrocarbons at the lowest possible rate of any orientation.

In an effort to alleviate the above described shortcomings, FIGS. 1C and 1D depict perforating formation 120, using an ultra high shot density perforating gun. FIGS. 1C and 1D show the same basic configuration as depicted in FIGS. 1A and 1B, with the exception of perforating gun 165. Rather than being loaded with four perforating charges per foot at 90° phase displacement, perforating gun 165 is loaded with eight shots per foot at 45° phasing. Note that perforating gun 165 carries twice the number of perforating charges 167 as in the prior example. While loading a perforating gun with high shot density at a relatively low phase displacement increases the chances that formation 120 will be perforated parallel to preferred vertical plane 195, there is no guarantee of success. Furthermore, the number of perforating charges expended in the effort is double, and the expense increases. Finally, because of size constraints of the maximum diameter of the perforating gun due to the interior diameter of the casing wall, at some shot density it is physically impossible to further increase the shot density due to the size of the individual charges. In many cases, smaller perforating charges must be supplemented in order to accommodate the increased shot density. In that case, the penetration of the individual charges is reduced, further reducing the production of hydrocarbons through the perforations.

It would be advantageous to provide a means for ensuring that the perforating charges carried in a perforating gun are oriented in a known direction. It would further be advantageous to orient perforating charges carried in a perforating gun with the preferred vertical plane of a formation, without the expense of using a workover rig. It would be even further advantageous to adapt existing technologies to an orientation means.

SUMMARY OF THE INVENTION

The present invention provides a method and apparatus for directionally orienting a perforating gun assembly or downhole tool assembly. A stinger is fabricated with an orientating key. The stinger is lowered into a wellbore and remains atop a downhole assembly. The stinger acts as a guide for coupling an alignment skirt. The alignment skirt is fabricated with an alignment slot for receiving the orientation key. The alignment skirt is lowered onto the stinger, and as inclines on the skirt engage the orientation key, the alignment skirt is rotated until the alignment slot receives the orientation key. The alignment skirt and stinger are then fully coupled. The angular orientation of the orientation key can be determined by coupling an alignment skirt to the stinger, where a directional tool is affixed to the alignment skirt and performs a directional survey. In subsequent runs in the wellbore, the angular orientation of a perforating assembly can be adjusted in order to align the direction of perforating charges within the gun assembly with a preferred vertical plane on the formation. This is accomplished by orienting (rotating) the alignment skirt on the gun assembly with respect to the orientation of the perforating charges and the orientation of the preferred vertical plane of the formation.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1B:
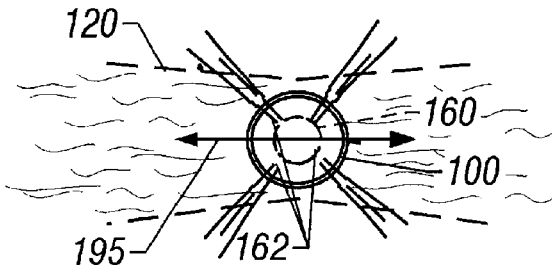
FIG. 1B (Prior Art)
FIGS. 1A through 1D depict perforating a wellbore using a modular gun assembly.
Figure 1D:
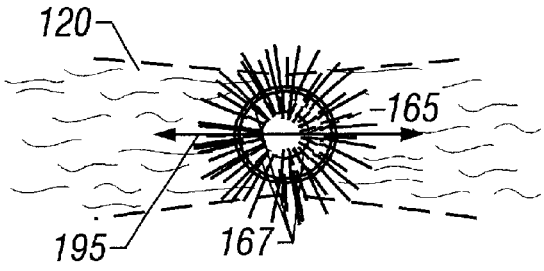
FIG. 1D (Prior Art)
Figure 1A:
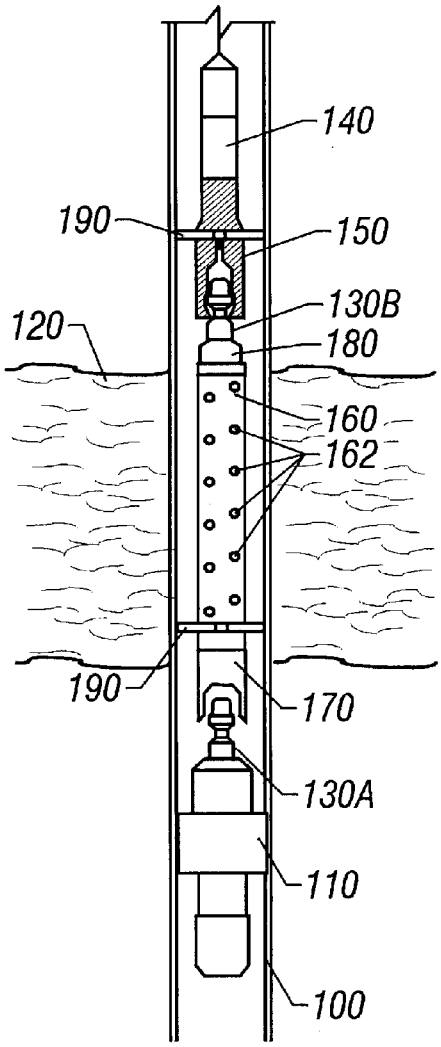
FIG. 1A (Prior Art)
Figure 1C:
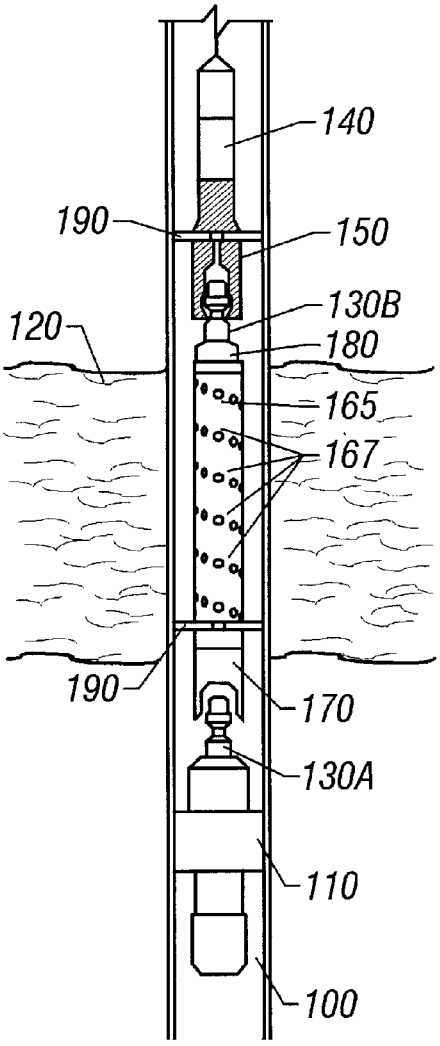
FIG. 1C (Prior Art)
Figure 2B:
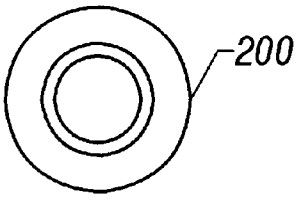
FIG. 2B (Prior Art)
FIGS. 2A through 2F depict stinger configurations as might be used atop gun hanger 110 or gun head 180, which is affixed to guns 160 and 165 shown in FIGS. 1A and 1C.
Figure 2D:
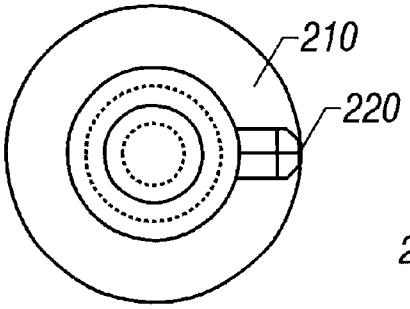
Figure 2F:
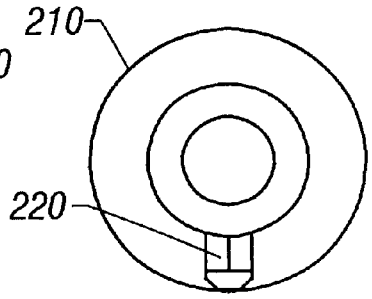
Figure 2A:
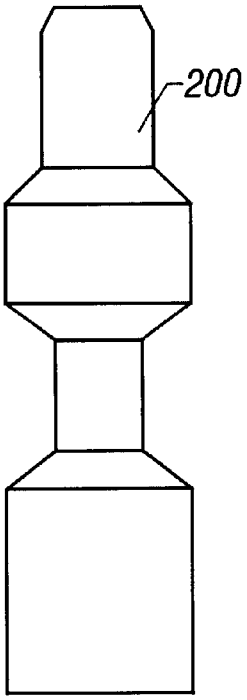
FIG. 2A (Prior Art)

FIGS. 2A to 2F depict stinger configurations as might be used atop gun hanger 110 or gun head 180, affixed to guns 160 and 165 shown in FIGS. 1A and 1C, respectively. Referring to FIGS. 2A and 2B, a prior art stinger 200 is depicted. After setting a downhole assembly, stinger 200 remains atop a downhole assembly and provides a coupling guide for coupling or mating of other tools or gun assemblies. As is well known in the art, a prior art stinger is fabricated as to only provide a centering guide for an alignment skirt affixed to the bottom of the tool or gun assembly. The tool or gun assembly is free to rotate on stinger 200 during coupling and, depending on the coupling, might be free to rotate on stinger 200 even after coupling. Once in place, the orientation of the tool or gun assembly with respect to the stinger cannot be precisely known for certain because the skirt is not restricted from rotating on stinger 200 during coupling.

Figure 2C:
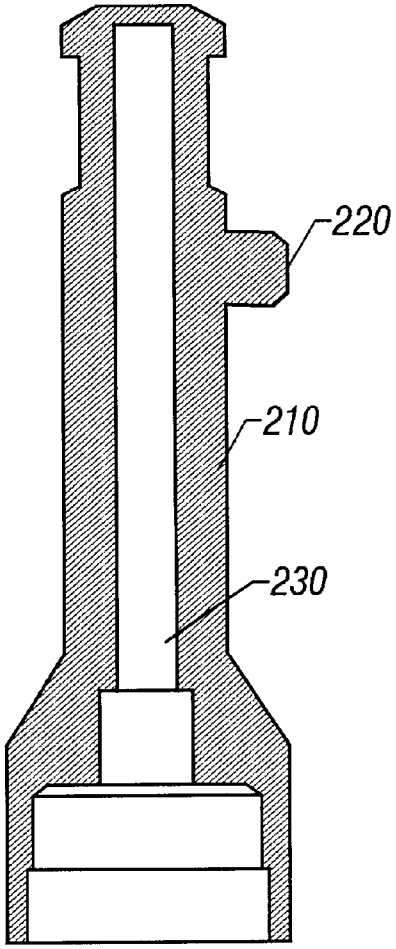
Figure 2E:
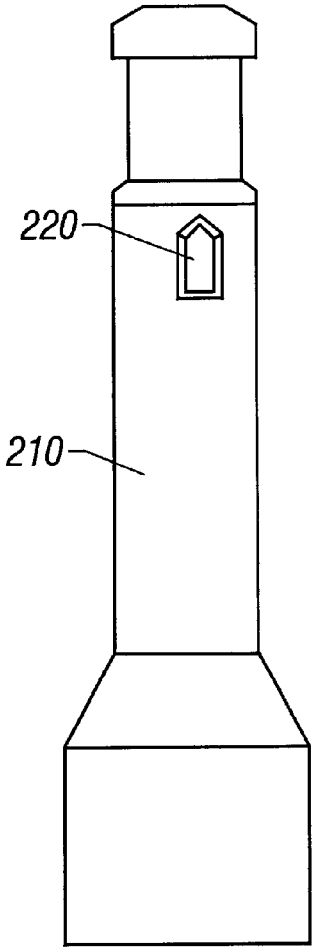

In contrast to stinger 200, stinger 210 depicted in FIGS. 2C through 2F provide an angular orientation guide, thus eliminating the possibility of uncontrolled tool rotation with respect to the stinger. Thus, the orientation of the tool or gun assembly can be determined from the orientation of the stinger. FIG. 2C is a cutaway side view of stinger 210, in accordance with a preferred embodiment of the present invention. Stinger 210 includes interior cavity 230 for placing explosives used to transfer an explosive shock wave from one downhole assembly to another without the explosives being in physical contact with each other. Additionally, stinger 210 incorporates orientation lug or key 220, which restricts the rotation of a slotted alignment skirt (discussed below) during coupling and thus orients the alignment skirt and attached tool or gun. In accordance with a preferred embodiment of the present invention, orientation key 220 includes a tapered upper surface which reduces the likelihood that the slotted alignment skirt will hang up on orientation key 220 during coupling. As shown in the top view of stinger 210, depicted in FIG. 2D, any alignment skirt attempting to couple with stinger 210 must be provided with a slot or channel for accommodating orientation key 220.

Figure 3A:
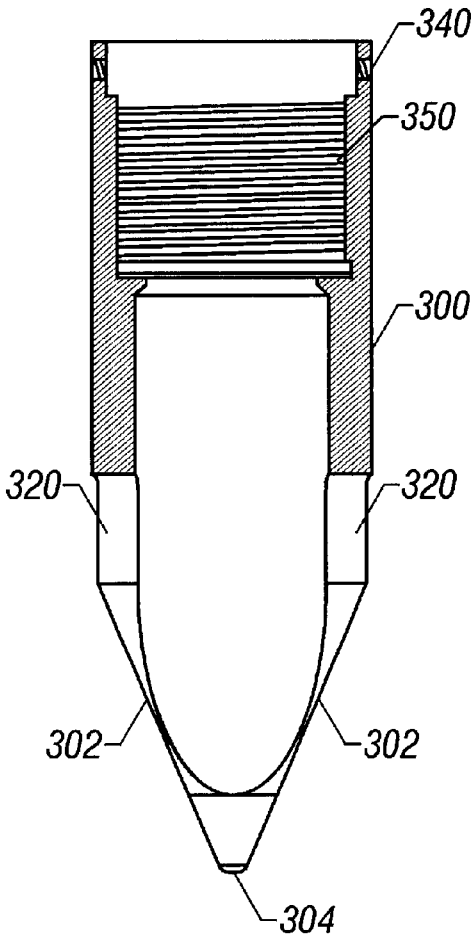
FIGS. 3A through 3D depict various views of alignment skirt 300 in accordance with a preferred embodiment of the present invention.
Figure 3C:
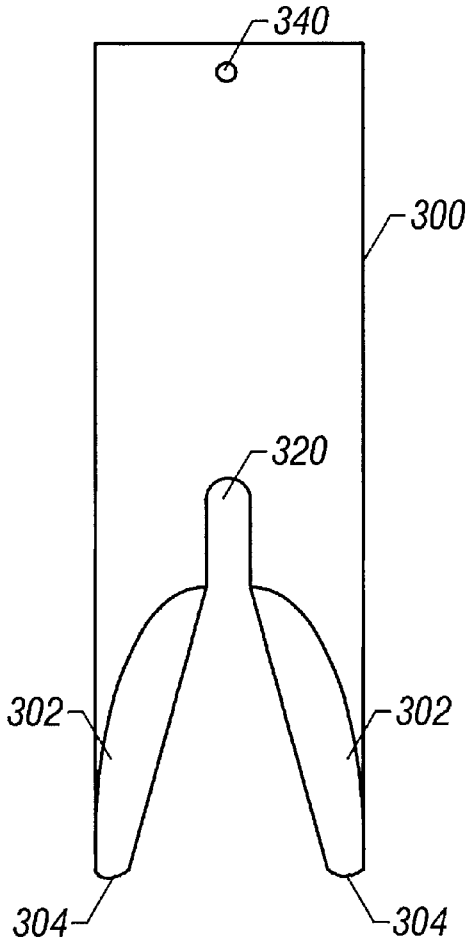
Figure 3B:
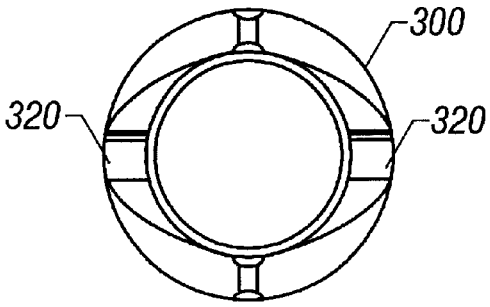
Figure 3D:
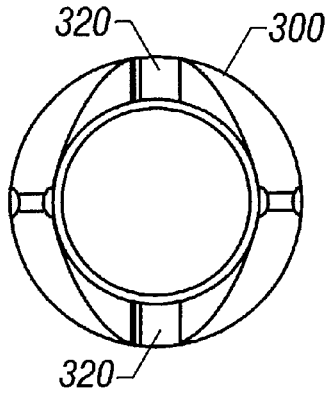

FIGS. 3A through 3D depict various views of alignment skirt 300 in accordance with a preferred embodiment of the present invention. FIG. 3A depicts a cutaway side view of orientation skirt 300, while FIG. 3B depicts the corresponding bottom view, as would be seen from the stinger. The orientation of alignment skirt 300 in FIGS. 3A and 3B corresponds to the orientation of stinger 210, as shown in FIGS. 2C and 2D. Additionally FIG. 3C depicts a front view of orientation skirt 300, while FIG. 3D depicts the corresponding bottom view as would be seen from the stinger.

Alignment skirt 300 comprises adapter connection threads 350 for attaching alignment skirt 300 to a gun adapter sub assembly or the like. Alignment skirt 300 makes up tightly onto the gun adapter (not shown), and threaded screw holes 340 enable set screws to be inserted to prevent locking alignment skirt 300 from loosening. The gun adapter is threaded with left-handed threads for receiving a threaded locking ring or threaded centralizer (also not shown). The locking ring can be repositioned on the gun adapter by rotating the threaded locking ring. This repositioning causes alignment skirt 300 to be angularly reoriented relative to the orientation of the gun adapter and also the orientation of the perforating charges in the perforating gun, as will be discussed with reference to FIG. 4.

Alignment skirt 300 further includes key alignment slot 320 for receiving the orientation key once the gun assembly is in the proper orientation. Bottom prongs 304 ensure proper orientation of the gun assembly by engaging the orientation key on the stinger if the gun assembly is 80 or 90 degrees out of phase with the orientation key, and then by forcing the gun assembly to rotate. Inclines 302 engage the orientation key, which further rotates both alignment skirt 300 and the gun assembly. Finally, alignment slot 320 is oriented in position for receiving the orientation key. Depending on the angular orientation of alignment skirt 300, bottom prongs 304 may not engage the orientation key. Instead, the orientation key may be engaged directly by inclines 302. Once in contact with the orientation key, inclines 302 guide the orientation key into alignment slot 320 in order to complete the coupling between the stinger and alignment skirt 300.

Figure 4:
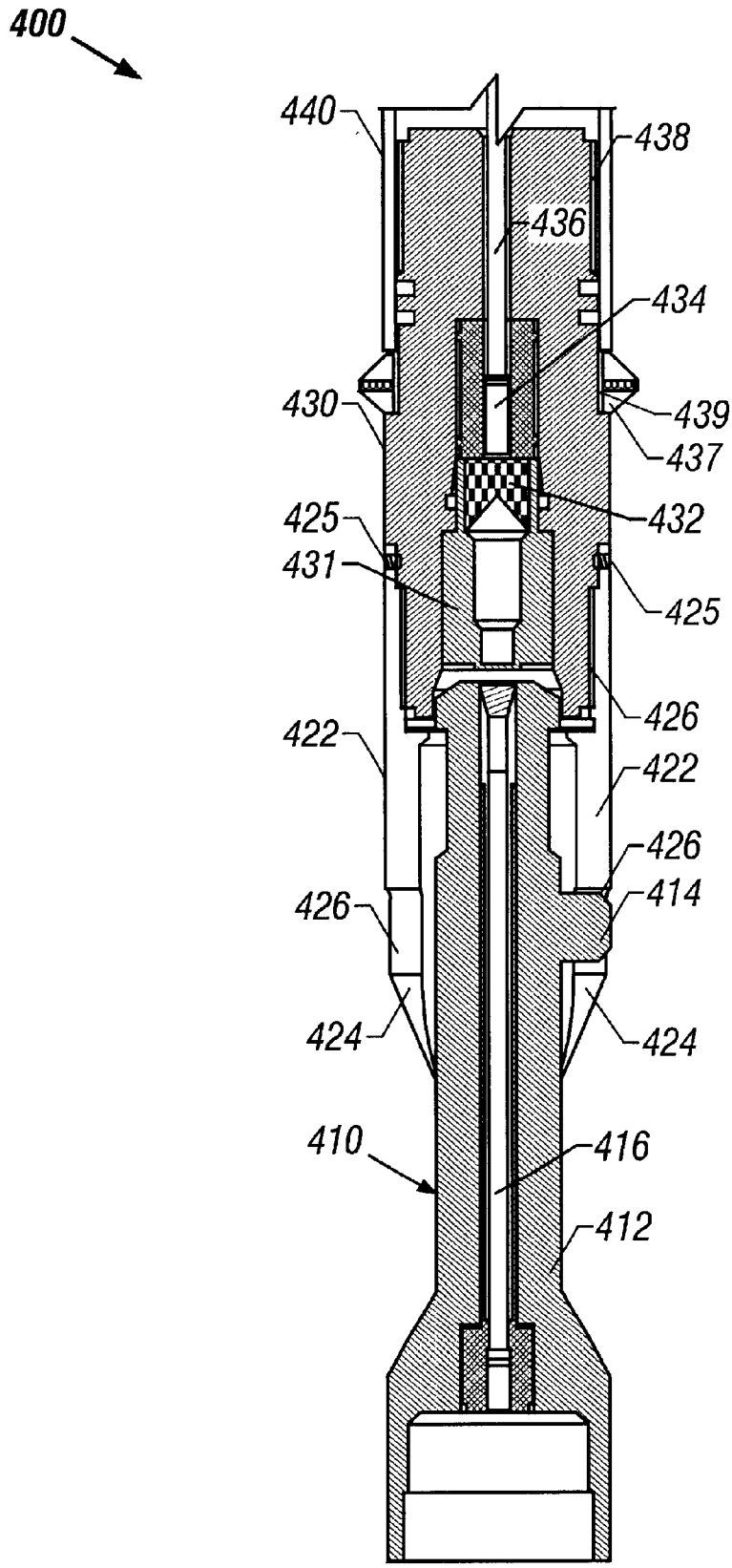
FIG. 4 depicts the stinger assembly coupled to the skirt assembly in accordance with a preferred embodiment of the present invention.

FIG. 4 depicts the stinger assembly coupled to the skirt assembly in accordance with a preferred embodiment of the present invention. Stinger assembly 410 comprises stinger 412, which is similar to stinger 210 depicted in FIG. 2C, including orientation key 414 and explosive insert 416. As discussed previously, stinger 410 acts as a guide for positioning alignment skirt 422 around stinger 412. In so doing, explosive components within explosive insert 416 are positioned proximate to shape charge insert assembly 431 and detonated by a jet slug emanating from shape charge 432. As also discussed previously, orientation key 414 acts as a rotational guide for orienting alignment skirt assembly 422, lower gun adapter assembly 430, and the perforating charges within gun carrier 440. As the gun assembly is lowered over stinger assembly 410, orientation key 414 engages the bottom prongs (not shown) and/or inclines 424, which rotate the gun assembly to the proper orientation, until orientation key 414 is received in one of alignment slots 426. It should be understood that, although the preferred embodiment of the present invention employs a single orientation key, two opposing alignment keys, positioned 180° apart on the stinger, might also be used for perforating guns loaded with perforating charges displaced by a 180° phase. Once orientation key 414 is totally received within alignment slot 426, the detonation from the upper gun assembly will be reliably transferred to the next lower explosive assembly. Importantly, the angular orientation of stinger 412 with respect to the gun hanger (not shown) is also adjustable; but still more importantly, the orientation of a stinger on subsequent perforation guns to be run may also be adjusted.

In the depicted example, alignment skirt assembly 422 is securely fastened to lower gun adapter assembly 430 by means of make-up threads 426, and set in place using locking screws 425. Angular orientation alignment skirt assembly 422, with respect to lower gun adapter assembly 430, is unimportant. This is because the angular orientation of alignment skirt assembly 422, with respect to perforating charges, is determined by the position of threaded centralizer 437 on lower gun adapter assembly 430. (If a centralizer is not used, a threaded locking ring may be substituted.) By repositioning threaded centralizer 437 on corresponding threads 439, which are located on lower gun adapter assembly 430, the orientation of alignment skirt assembly 422 with respect to perforating charges in gun carrier 440 is adjusted. Once adjusted, the angular orientation is rotationally fixed by forcibly abutting (making up) centralizer 437 to gun carrier 440 via make-up threads 438. The stinger positioned above intermediate perforating guns may also be angularly adjusted for orienting the intermediate section of a perforated interval. The above described positioning process may be implemented on the lower gun adapter of each gun when more than one perforating gun is to be used.

The explosives path through lower gun adapter 430 starts in the perforating gun with detonation cord 436, which is terminated with booster 434, adjacent to shape charge 432. Once the shape charges (not shown) within gun carrier 440 are initiated, a pressure wave travels through detonation cord 436 and ignites booster 434, which in turn detonates shape charge 432. The pressure wave is then transferred to explosive insert 416 in stinger assembly 410, which propagates the pressure wave to the explosive component in the next lower assembly (not shown).

FIGS. 5A through 5J illustrate the process of orienting a perforating gun using a stinger with an alignment key and slotted alignment skirt for receiving the orientation key. The process begins with gun hanger 510 being conveyed into casing 500 by means of running tool 550. Gun hanger 510 is positioned relative to formation of interest 520 by collar locator 540; and centralizer 590 keeps gun hanger 550 in the center of casing 500 to ensure a good set. Once gun hanger 510 is positioned at the setting depth, running tool 550 sets gun hanger 510 in casing 500 by a reciprocating motion, and running tool 550 is released from gun hanger 510. Running tool 550 and collar locator 540 are then removed from casing 500, leaving stinger 530 in an upturned position atop gun hanger 510. Stinger 530 further includes orientation key 537, which is used for orienting a gun assembly relative to a preferred vertical plane, depicted as arrow 595 in FIG. 5B.

As discussed above, permeability and porosity are not necessarily uniform throughout a formation. The permeability and porosity might be oriented in a particular direction with respect to the wellbore. Depending on the selected type well completion and formation reservoir characteristics, the preferred orientation of the perforating charges might be parallel to the orientation of the permeability and porosity of the formation, or perpendicular to the orientation of the permeability and porosity of the formation. Although the preferred vertical plane in the depicted example appears to be parallel to the orientation of porosity and/or permeability, particularly for formation 520, in other well perforating operations, the preferred vertical plane might be perpendicular to the orientation of porosity and/or permeability.

Figure 5B:
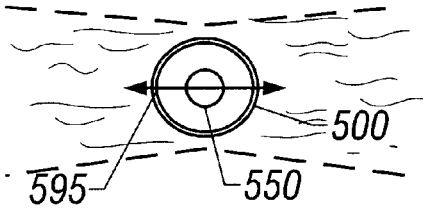
FIGS. 5A through 5J illustrate the process of orienting a perforating gun using a stinger with an alignment key and an alignment skirt for receiving the orientation key.
Figure 5D:
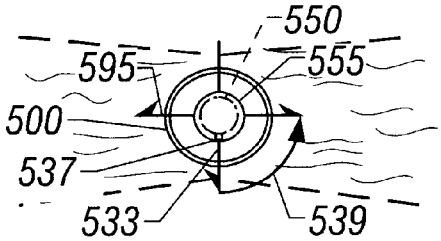
Figure 5A:
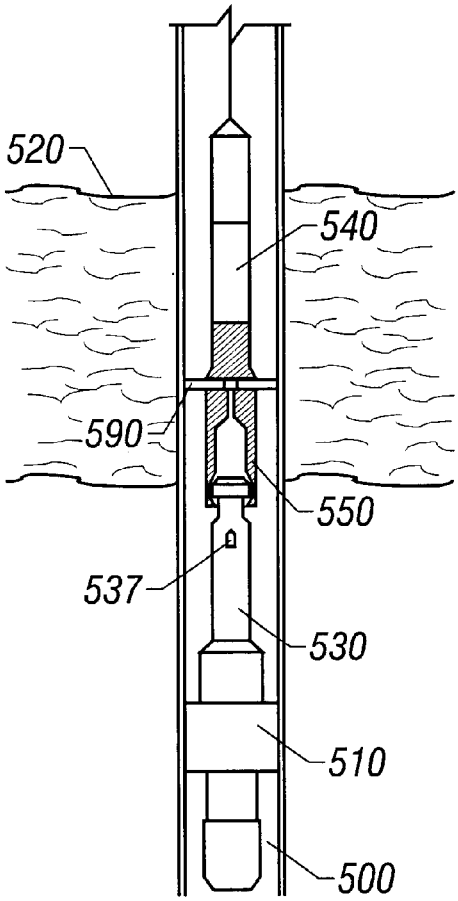
Figure 5C:
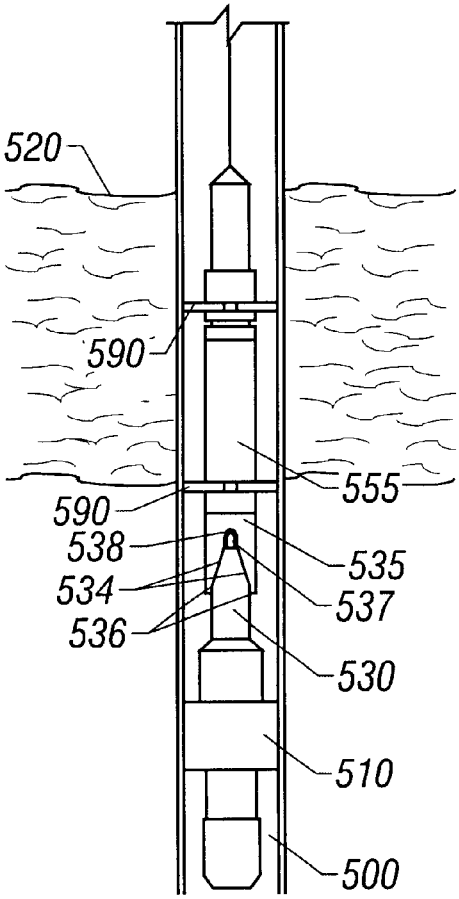

FIG. 5C is a diagram illustrating running of the directional survey for determining the angular orientation of orientation key 537 on stinger 530. The angular orientation of orientation key 537 is determined by coupling downhole directional tool 555 to stinger 530. Alignment skirt 535 is attached to the bottom of downhole orientation tool 555, and the tool is centralized in casing 500 using centralizers 590. As discussed with respect to FIGS. 3A through 3D above, alignment skirt 535 is fabricated with a pair of alignment slots (one shown 538) for receiving orientation key 537. As downhole directional tool 555 is lowered onto stinger 530, orientation key 537 guides the pair of bottom prongs 536 around orientation key 537 and then engages incline 534.

Each set of inclines terminates in an alignment slot. No matter what is the initial orientation of alignment skirt 535, the configuration of alignment skirt 535, including bottom prongs 536 and inclines 534, forces alignment skirt 535 to rotate, thereby allowing orientation key 537 to be received within alignment slot 538 on alignment skirt 535. Once in position, an angular orientation reading is taken by downhole directional tool 555. As can be seen in FIG. 5D, the angular orientation of orientation key 537 on stinger 530 is represented as arrow 533 with respect to casing 500. In the depicted example, the angular orientation of orientation key 537 (as determined by directional tool 555) is approximately due south, while the preferred vertical plane runs east-west, as depicted by arrow 595. Therefore, the alignment skirt attached to the bottom of a gun assembly must be oriented accordingly. In this example, the formation is to be perforated with the perforating charges, creating perforating jets, which are parallel to preferred vertical plane 595. On the perforating gun assembly, alignment skirt 535 must be oriented 90° from the orientation of the perforating charges in the gun assembly, as shown by orientation correction arrow 539.

The depicted example deals with the case of perforating a preferred vertical plane in a formation with a perforating gun, having perforating charges oriented at 180° shot phasing. While this is the preferred embodiment of the present invention, one of ordinary skill in the art would understand that the alignment skirt could be easily modified for orienting a perforating gun with 0° shot phasing. This is accomplished by eliminating one bottom prong, a set of inclines, and the corresponding alignment slot on the alignment skirt. Thus, only a single bottom prong and two inclines remain to guide the orientation key into the single alignment slot, and the angular orientation of the alignment skirt is restricted to the angular orientation of the orientation key on the stinger. In the embodiment described above, using the alignment skirt described with respect to FIGS. 3A through 3D, the angular orientation of the alignment skirt is not restricted to the particular angular orientation of the orientation key but may be oriented 180° out of phase with the orientation key due to the second alignment slot on the alignment skirt. Therefore, that alignment skirt would be unsuitable for orienting 0° phase gun assemblies in a specific direction.

Figure 5J:
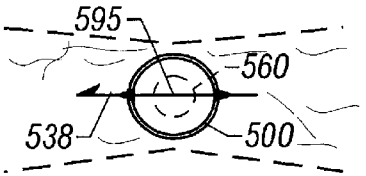
Figure 5I:
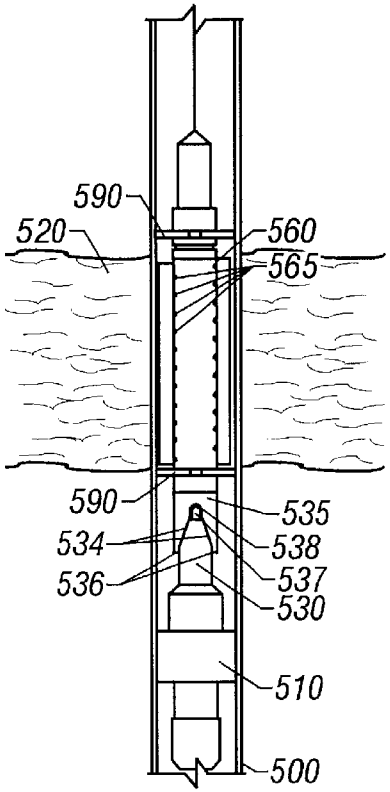
Figure 5H:
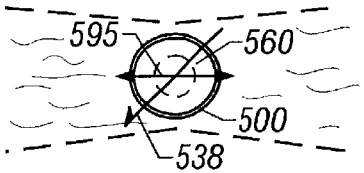
Figure 5G:
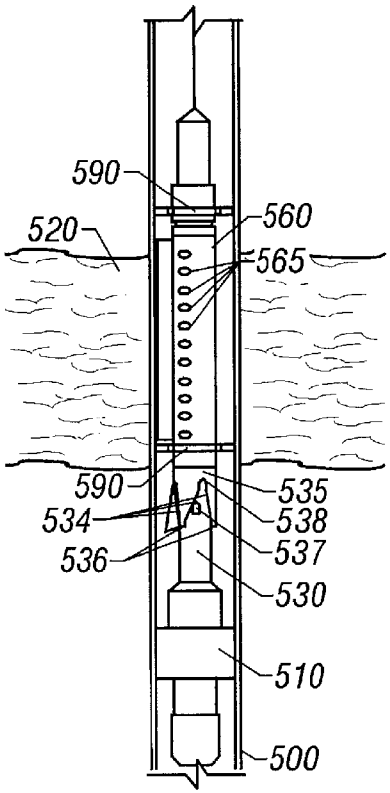
Figure 5F:
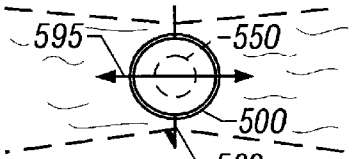
Figure 5E:
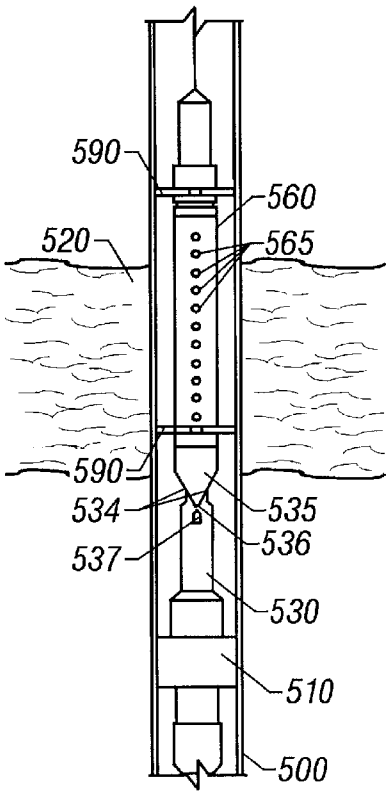

FIGS. 5E through 5I depict perforating gun 560 being oriented to preferred vertical plane 595 by coupling with stinger 530. FIGS. 5E and 5F show front and top views of the position of perforating gun 560, including the angular orientation of perforating charges 565. Note that, initially, the angular orientation of perforating charges 565 is approximately 90° out of phase with preferred vertical plane 595, as shown by gun orientation arrow 538, both shown in FIG. 5F. Note also that bottom prong 536 is directly above orientation key 537.

FIGS. 5G and 5H depict the angular orientation of perforating gun 560, perforating charges 565, and alignment skirt 535, after bottom prong 536 has contacted orientation key 537, causing alignment skirt 535 to be rotated along incline 534. By comparing gun orientation arrow 538 in FIGS. 5H and 5F, note that the engagement of alignment skirt 535 and stinger 530 has caused perforating charges 565 to be rotated approximately 45°. As the gun assembly is further lowered, the rotation continues until orientating key 537 is fully received within alignment slot 538, as depicted in FIG. 51. At that point, perforating charges 565 are directionally oriented parallel with preferred vertical plane 595, as seen in FIG. 5J. Perforating gun 560 is now in position and directionally oriented to detonate perforating charges 565.

Figure 5K:
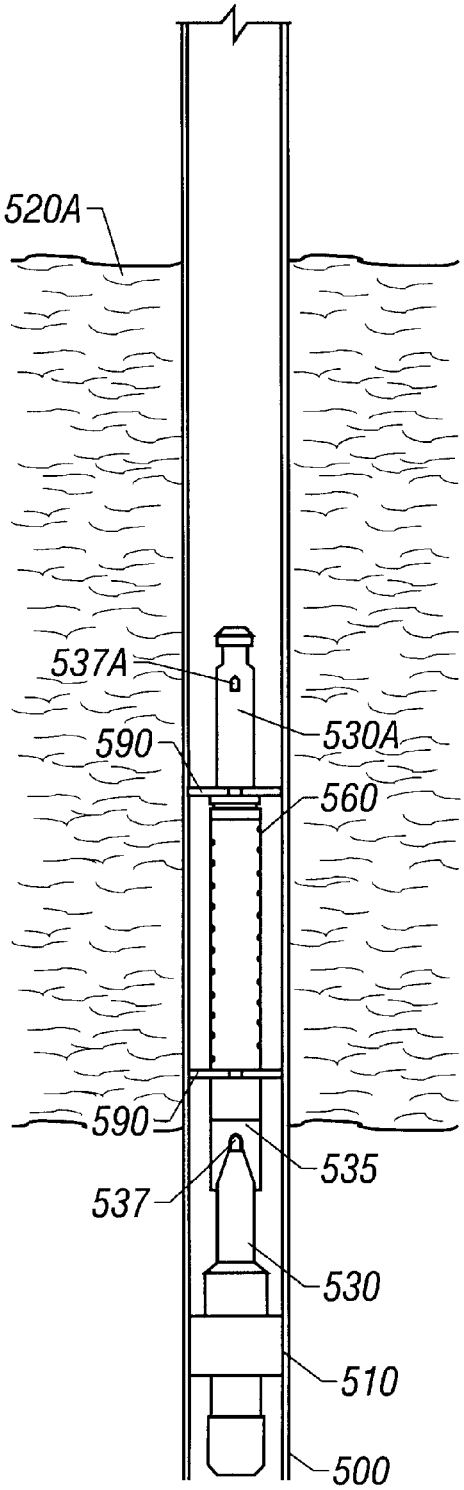
FIGS. 5K through 5M illustrate the process of orienting a plurality of perforating guns using stingers with an alignment key and alignment skirts for receiving the orientation keys.
Figure 5L:
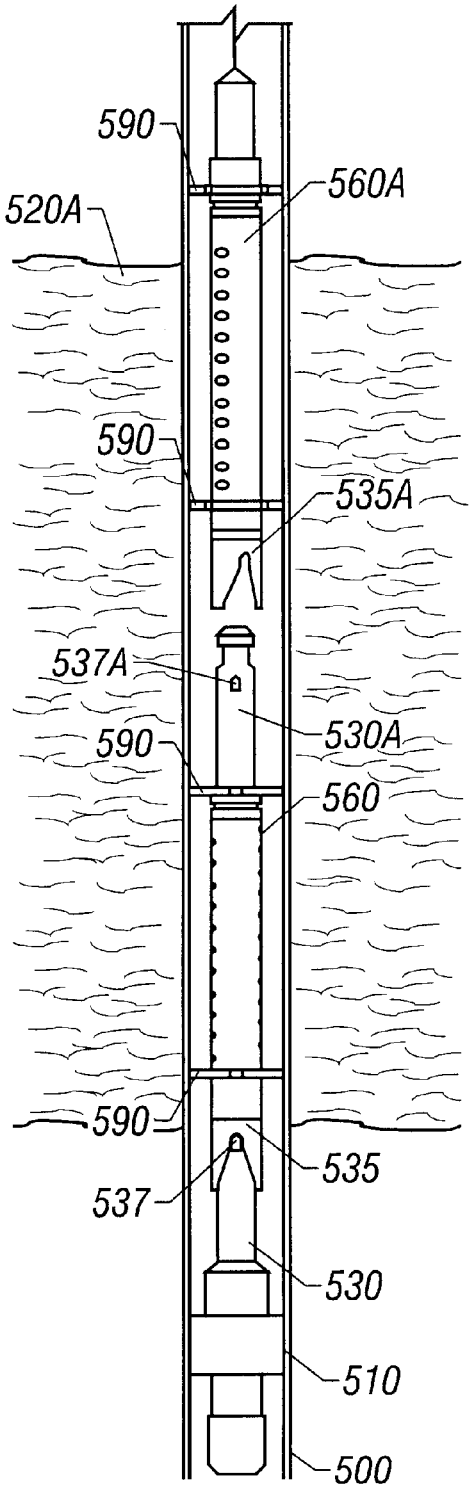
Figure 5M:
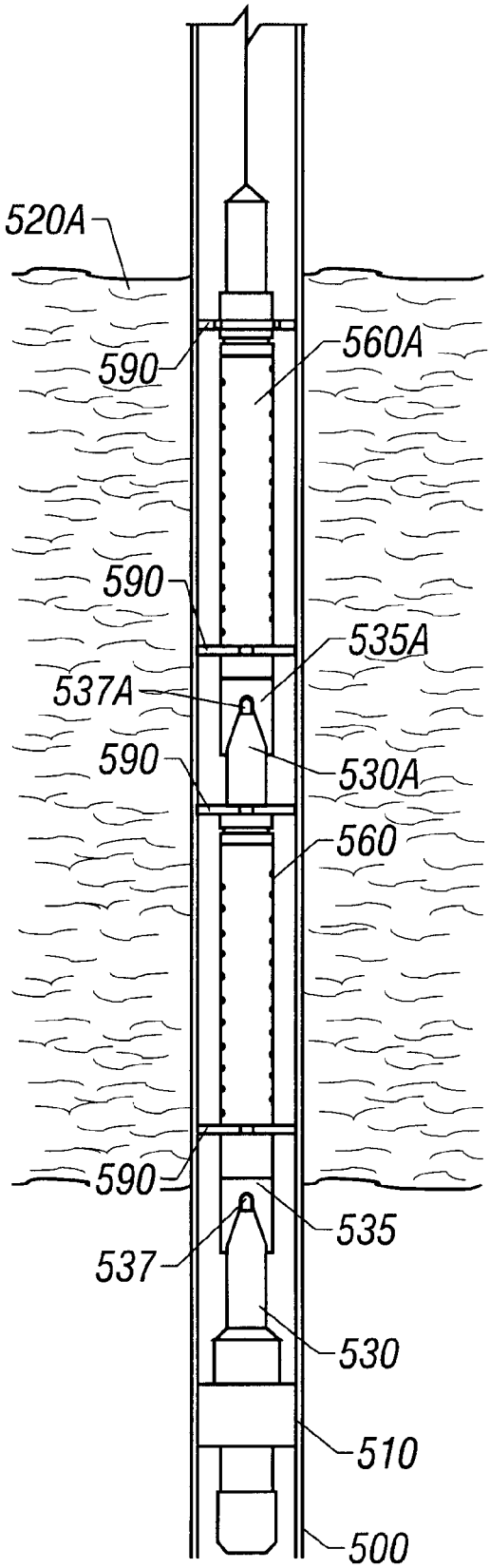

While, in the above-described example, only a single perforating gun is positioned, multiple perforating guns may be coupled to each other using another preferred embodiment of the present invention. As shown in FIGS. 5K through 5M, by configuring each intermediate perforating gun 560, 560*a* with a lower alignment skirt 535, 535*a* and an upper stinger 530*a*, multiple perforating guns might be coupled together. This allows for simultaneous perforation of extremely long formations 520*a*, which was previously not possible on wireline alone due to the weight limitations of the wireline.

Although preferred embodiments of the present invention have been described in the foregoing Detailed Description, and illustrated in the accompanying drawings, it will be understood that the invention is not limited to the embodiments disclosed but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

What is claimed is:

1. A method of orienting a downhole device, comprising the steps of:

(a) running a hanger comprising a stinger into a well;

(b) setting the hanger;

(c) performing a directional survey to determine the angular orientation of the stinger in the well, and (d) adjusting the angular orientation of a an alignment skirt relative to a downhole device based on the angular orientation of the stinger in the well, wherein the alignment skirt is mated to the downhole device.

2. The method recited in claim 1, wherein an orientation key is affixed to the stinger, and the alignment skirt is fabricated with an alignment slot for receiving the orientation key affixed to the stinger.

3. The method recited in claim 1, wherein the downhole device is a perforating gun, and the angular orientation of the stinger in the well is used to compute the angular orientation of a plurality of perforating charges within the perforating gun.

4. The method recited in claim 3 further comprises:

(e) detonating the perforating gun.

5. The method recited in claim 3, wherein each perforating charge within the perforating gun is oriented at a 180° phase from the adjacent perforating charge.

6. The method recited in claim 1, wherein the downhole device is conveyed in the well by wireline.

7. The method recited in claim 1, wherein the downhole device is conveyed in the well by means of tubing.

8. The method recited in claim 1, wherein the stinger is a first stinger, the alignment skirt is a first alignment skirt and the downhole device is a first downhole device, the method further comprising:

(e) running a first downhole assembly comprised of the first downhole device and the first alignment skirt and a second stinger affixed thereto into the well;

(f) coupling the first alignment skirt mated to the first downhole assembly to the first stinger;

(g) adjusting the angular orientation of a second alignment skirt relative to a second downhole device based on the angular orientation of the first stinger in the well, wherein the second alignment skirt is mated to the second downhole device;

(h) running the second downhole device and the mated second alignment skirt into the well; and (i) coupling the second alignment skirt mated to the second downhole device to the second stinger.

9. A system for angular orienting a downhole device comprising:

(a) a stinger comprising a generally linear shaft and an orientation key, wherein the stinger is positioned downhole;

(b) a slotted alignment skirt comprising an alignment slot for receiving the orientation key, wherein the slotted alignment skirt is lowered downhole on to the stinger and further wherein the slotted alignment skirt couples the downhole device to the stinger when the orientation key is received within the alignment slot; and (c) an angular orientation tool mechanically connected to the slotted alignment skirt capable of adjusting the angular orientation of the alignment skirt relative to a downhole device.

10. The system for angular orienting a downhole device recited in claim 9, wherein the stinger and slotted alignment skirt are conveyed into the well by cable.

11. The system for angular orienting a downhole device recited in claim 9, wherein the downhole device is a perforating gun.

12. The system for angular orienting a downhole device recited in claim 9, wherein the stinger and slotted alignment skirt are conveyed downhole by means of tubing.

13. The system for angular orienting a downhole device recited in claim 9, wherein angular orientation of the downhole device is adjustable relative to the angular orientation of the stinger.

14. The system for angular orienting a downhole device recited in claim 9, wherein the stinger is a first stinger, the slotted alignment skirt is a first slotted alignment skirt and the downhole device is a first downhole device, further comprising:

(d) a second stinger comprising a generally linear shaft and an alignment key, wherein the second stinger is mechanically connected to the first downhole device; and (e) a second slotted alignment skirt mechanically connected to the second downhole device comprising an alignment slot for receiving the alignment key, wherein the second slotted alignment skirt couples to the second stinger when the alignment key is received within the alignment slot.

15. A system for angular orienting a plurality of downhole devices comprising:

(a) a hanger positioned downhole which incorporates a first stinger, wherein said first stinger is comprised of a generally linear shaft and an orientation key;

(b) an angular orientation tool mechanically connected to a first alignment skirt for coupling with the first stinger and determining the angular orientation of the first stinger;

(c) a plurality of downhole devices, each comprising:

(i) a device element;

(ii) a stinger element affixed to the top of said device element, wherein said stinger element is comprised of a generally linear shaft and an alignment key;

(iii) an alignment skirt element affixed to the bottom of said device element, wherein said skirt comprises an alignment slot for receiving another device's alignment key or the orientation key, and wherein said skirt couples and orients the device element when another device's alignment key or the orientation key is received within the alignment slot.

16. The system for angular orienting a plurality of downhole devices recited in claim 15, wherein at least one downhole device is conveyed into the well by cable.

17. The system for angular orienting a plurality of downhole devices recited in claim 15, wherein the angular orientation of each stinger element is adjustable.

18. The system for angular orienting a plurality of downhole devices recited in claim 15, wherein the angular orientation of each alignment skirt element is adjustable.

19. The system for angular orienting a plurality of downhole device recited in claim 15, wherein the first stinger and each stinger element may be adapted to facilitate a positive transfer of detonation force.

20. The system for angular orienting a plurality of downhole devices recited in claim 19, wherein at least one downhole device is a perforating gun.

21. A method of orienting a plurality of downhole devices, comprising the steps of:

(a) running a hanger comprising a first stinger into a well;

(b) setting the hanger;

(c) performing a directional survey to determine the angular orientation of the first stinger in the well;

(d) adjusting the angular orientation of a first alignment skirt on a first downhole device based on the angular orientation of the first stinger in the well, wherein the first alignment skirt is mated to the first downhole device;

(e) adjusting the angular orientation of a second alignment skirt and a second downhole device based on the angular orientation of a second stinger mated to the first downhole device, wherein the second alignment skirt is mated to the second downhole device;

(f) coupling the first alignment skirt to the first stinger; and (g) coupling the second alignment skirt to the second stinger.

22. The method recited in claim 21, wherein an orientation key is affixed to each stinger, and each alignment skirt is fabricated with an alignment slot for receiving the orientation key affixed to the stinger.

23. The method recited in claim 21, wherein at least one downhole device is conveyed in the well by wireline.

24. The method recited in claim 21, wherein at least one downhole device is conveyed in the well by means of tubing.

25. The method recited in claim 21, wherein each stinger may be adapted to facilitate a positive transfer of detonation force.

26. The method recited in claim 25, wherein at least one downhole device is a perforating gun, and the angular orientation of the first stinger is used to compute the angular orientation of perforating charges within the perforating gun.

27. The method recited in claim 26 further comprises:

(h) detonating the perforating gun.

28. The method recited in claim 27, wherein each perforating charge within the perforating gun is oriented at a 180° phase from the adjacent perforating charge.

29. The method recited in claim 27, wherein each perforating charge within the perforating gun is oriented at a 0° phase from the adjacent perforating charge.

* * * * *